US008769806B2

(12) United States Patent
Koroishi et al.

(10) Patent No.: US 8,769,806 B2
(45) Date of Patent: Jul. 8, 2014

(54) METHOD OF MANUFACTURING THERMAL HEAD

(75) Inventors: Keitaro Koroishi, Chiba (JP); Noriyoshi Shoji, Chiba (JP); Norimitsu Sanbongi, Chiba (JP); Toshimitsu Morooka, Chiba (JP)

(73) Assignee: Seiko Instruments Inc. (JP)

( * ) Notice: Subject to any disclaimer, the term of this patent is extended or adjusted under 35 U.S.C. 154(b) by 276 days.

(21) Appl. No.: 13/200,250

(22) Filed: Sep. 21, 2011

(65) Prior Publication Data

US 2012/0073122 A1 Mar. 29, 2012

(30) Foreign Application Priority Data

Sep. 24, 2010 (JP) ..... 2010-213292

(51) Int. Cl.
*H05B 3/00* (2006.01)

(52) U.S. Cl.
USPC ..... 29/611; 29/610.1; 29/846; 29/890.1

(58) Field of Classification Search
USPC ..... 29/611, 610.1, 825, 846, 890.03, 890.1; 347/200, 202, 205–207
See application file for complete search history.

(56) References Cited

U.S. PATENT DOCUMENTS 5,940,109 A * 8/1999 Taniguchi et al. ..... 347/205
7,768,541 B2 * 8/2010 Koroishi et al. ..... 347/202

FOREIGN PATENT DOCUMENTS

JP 2010094939 4/2010

* cited by examiner

*Primary Examiner* — Thiem Phan
(74) *Attorney, Agent, or Firm* — Adams & Wilks

(57) ABSTRACT

In a method of manufacturing a thermal head, a groove portion is formed in one surface of at least one of a first substrate and a second substrate, and a width dimension of the groove portion is measured. The first and second substrates are bonded to each other in a stacked state so as to close an opening of the groove portion. A heating resistor is formed on a surface of the second substrate in a region opposed to the groove portion. A protective film for covering and protecting the heating resistor is formed on the surface of the second substrate. A thickness dimension of the protective film is set so as to increase with an increase in the measured width dimension of the groove portion and so as to decrease with an increase in a thickness dimension of the second substrate.

15 Claims, 11 Drawing Sheets

| CONCAVE PORTION WIDTH A [μm] | HEATING EFFICIENCY |
|---|---|
| 140 | 1.78 |
| 160 | 1.79 |
| 180 | 1.81 |
| 200 | 1.83 |
| 220 | 1.85 |
| 240 | 1.87 |
| 260 | 1.88 |
| 280 | 1.90 |
| 300 | 1.92 |

| CONCAVE PORTION WIDTH B [μm] | HEATING EFFICIENCY |
|---|---|
| 0 | 1.08 |
| 1 | 1.25 |
| 2 | 1.36 |
| 5 | 1.52 |
| 10 | 1.63 |
| 25 | 1.74 |
| 50 | 1.80 |
| 100 | 1.83 |
| 200 | 1.84 |

| CONCAVE PORTION WIDTH C [μm] | HEATING EFFICIENCY |
|---|---|
| 1 | 2.25 |
| 10 | 2.04 |
| 20 | 1.83 |
| 30 | 1.66 |
| 40 | 1.51 |
| 50 | 1.39 |
| 60 | 1.29 |
| 70 | 1.21 |
| 80 | 1.14 |
| 90 | 1.09 |
| 100 | 1.06 |

| CONCAVE PORTION WIDTH D [μm] | HEATING EFFICIENCY |
|---|---|
| 1 | 2.43 |
| 2 | 2.33 |
| 3 | 2.23 |
| 4 | 2.13 |
| 5 | 2.03 |
| 6 | 1.93 |
| 7 | 1.83 |
| 8 | 1.73 |
| 9 | 1.63 |
| 10 | 1.53 |
| 11 | 1.43 |
| 12 | 1.33 |
| 13 | 1.23 |
| 14 | 1.13 |

FIG.9A

| | | |
|---|---|---|
| CONCAVE PORTION WIDTH | A | 200 |
| CONCAVE PORTION DEPTH | B | 100 |
| UPPER SUBSTRATE THICKNESS | C | 50 |
| PROTECTIVE FILM THICKNESS | D | 7 |
| TARGET HEATING EFFICIENCY | E | 1.39 |

FIG.9B

| | | MEASUREMENT VALUE 1 | CHANGE RATE | MEASUREMENT VALUE 2 | CHANGE RATE | MEASUREMENT VALUE 3 | CHANGE RATE |
|---|---|---|---|---|---|---|---|
| CONCAVE PORTION WIDTH | a | 218 | 0.9% | 183 | -0.9% | 204 | 0.2% |
| CONCAVE PORTION DEPTH | b | 109 | 0.2% | 92 | -0.2% | 102 | 0.0% |
| UPPER SUBSTRATE THICKNESS | c | 43 | 6.0% | 57 | -5.3% | 48 | 1.6% |
| ESTIMATED HEATING EFFICIENCY OF a, b AND c | e1 | 1.49 | 7.1% | 1.30 | -6.4% | 1.42 | 1.9% |
| APPROPRIATE THICKNESS OF PROTECTIVE FILM | d | 8.3 | -7.1% | 5.8 | 6.4% | 7.3 | -1.9% |
| ESTIMATED HEATING EFFICIENCY | e2 | 1.36 | | 1.41 | | 1.38 | |

FIG.10A

| | | |
|---|---|---|
| CONCAVE PORTION WIDTH | A | 280 |
| CONCAVE PORTION DEPTH | B | 50 |
| UPPER SUBSTRATE THICKNESS | C | 80 |
| PROTECTIVE FILM THICKNESS | D | 5 |
| TARGET HEATING EFFICIENCY | E | 1.38 |

FIG.10B

| | | MEASUREMENT VALUE 1 | CHANGE RATE | MEASUREMENT VALUE 2 | CHANGE RATE | MEASUREMENT VALUE 3 | CHANGE RATE |
|---|---|---|---|---|---|---|---|
| CONCAVE PORTION WIDTH | a | 300 | 1.0% | 264 | -0.8% | 284 | 0.2% |
| CONCAVE PORTION DEPTH | b | 58 | 0.3% | 43 | -0.3% | 52 | 0.1% |
| UPPER SUBSTRATE THICKNESS | c | 73 | 4.6% | 86 | -3.6% | 79 | 0.6% |
| ESTIMATED HEATING EFFICIENCY OF a, b AND c | e1 | 1.45 | 5.9% | 1.33 | -4.7% | 1.39 | 0.9% |
| APPROPRIATE THICKNESS OF PROTECTIVE FILM | d | 6.1 | -5.9% | 4.1 | 4.7% | 5.2 | -0.9% |
| ESTIMATED HEATING EFFICIENCY | e2 | 1.34 | | 1.41 | | 1.38 | |

FIG.11A

| | | |
|---|---|---|
| CONCAVE PORTION WIDTH | A | 150 |
| CONCAVE PORTION DEPTH | B | 180 |
| UPPER SUBSTRATE THICKNESS | C | 25 |
| PROTECTIVE FILM THICKNESS | D | 10 |
| TARGET HEATING EFFICIENCY | E | 1.42 |

FIG.11B

| | | MEASUREMENT VALUE 1 | CHANGE RATE | MEASUREMENT VALUE 2 | CHANGE RATE | MEASUREMENT VALUE 3 | CHANGE RATE |
|---|---|---|---|---|---|---|---|
| CONCAVE PORTION WIDTH | a | 164 | 0.7% | 136 | -0.7% | 152 | 0.1% |
| CONCAVE PORTION DEPTH | b | 188 | 0.1% | 166 | -0.2% | 182 | 0.0% |
| UPPER SUBSTRATE THICKNESS | c | 20 | 5.2% | 29 | -3.8% | 24 | 1.0% |
| ESTIMATED HEATING EFFICIENCY OF a, b AND c | e1 | 1.52 | 6.0% | 1.33 | -4.8% | 1.44 | 1.1% |
| APPROPRIATE THICKNESS OF PROTECTIVE FILM | d | 11.1 | -6.0% | 9.1 | 4.8% | 10.2 | -1.1% |
| ESTIMATED HEATING EFFICIENCY | e2 | 1.41 | | 1.42 | | 1.41 | |

METHOD OF MANUFACTURING THERMAL HEAD

BACKGROUND OF THE INVENTION

1. Field of the Invention

The present invention relates to a method of manufacturing a thermal head.

2. Description of the Related Art

There has been conventionally known a method of manufacturing a thermal head for use in thermal printers (see, for example, Japanese Patent Application Laid-open No. 2010-94939). In the method of manufacturing a thermal head described in Japanese Patent Application Laid-open No. 2010-94939, a concave portion is formed in one surface of an upper substrate, and a support substrate is bonded onto the upper substrate so as to close the concave portion. After that, heating resistors are formed on a rear surface of the upper substrate in a region opposed to the concave portion, and then the rear surface is covered by a protective film, to thereby manufacture a thermal head which has a cavity portion between the upper substrate and the support substrate.

In the thermal head manufactured in this way, the cavity portion functions as a heat-insulating layer of low thermal conductivity to reduce an amount of heat transferring from the heating resistors toward the support substrate side via the upper substrate, to thereby increase an amount of heat to be utilized for printing and increase heating efficiency. The heating efficiency is determined by dimensions of the concave portion, a thickness dimension of the upper substrate, resistances of the heating resistors, a thickness dimension of the protective film, and the like. It is therefore required to reduce fluctuations in such dimensions.

However, in the manufacturing process for a thermal head, the above-mentioned dimensions, resistances, and the like fluctuate among the substrates or lots. Further, the concave portion and the upper substrate are disposed under the heating resistors, the electrodes, the protective film, and the like, and hence the dimensions cannot be measured or corrected at a final stage after the thermal head is assembled. Therefore, the conventional manufacturing method has a problem that fluctuations in heating efficiency cannot be suppressed and it is difficult to manufacture a thermal head having stable quality.

SUMMARY OF THE INVENTION

The present invention has been made in view of the above-mentioned circumstances, and it is an object thereof to provide a method capable of manufacturing a thermal head having high heating efficiency and stable quality.

In order to achieve the above-mentioned object, the present invention provides the following measures.

The present invention provides a method of manufacturing a thermal head, including: forming a groove portion, which is opened in one surface of at least one of a first substrate and a second substrate to be disposed on the first substrate in a stacked state, the first substrate and the second substrate each being of a plate shape; measuring a width dimension of the groove portion formed in the forming of the groove portion; bonding the first substrate and the second substrate to each other in the stacked state so as to close an opening of the groove portion formed in the forming of the groove portion; forming a heating resistor on a surface of the second substrate, which is bonded onto the first substrate in the bonding, in a region opposed to the groove portion; and forming a protective film for covering and protecting the heating resistor on the second substrate, at a thickness which is set based on the width dimension of the groove portion and a thickness dimension of the second substrate.

According to the present invention, the groove portion, which is formed in the groove portion forming step, is closed by bonding the first substrate and the second substrate to each other in the stacked state in the bonding step, to thereby form a stacked substrate having a cavity portion at a stacked portion between the first substrate and the second substrate. Further, the heating resistor, which is formed in the heating resistor forming step, is disposed so as to be opposed to the groove portion, and hence the cavity portion functions as a hollow heat-insulating layer that prevents heat from transferring toward the first substrate side from the heating resistor via the second substrate, to thereby increase heating efficiency.

In this case, the heating efficiency is determined by the dimensions of the groove portion, the thickness of the second substrate (distance from the heating resistor to the cavity portion), the resistance of the heating resistor, the thickness of the protective film, and the like. In the present invention, the thickness of the protective film, which is formed in the protective film forming step, is set based on the width dimension of the groove portion and the thickness dimension of the second substrate. Accordingly, fluctuations in width among the groove portions and fluctuations in thickness of the second substrate can be cancelled through adjustment to the thickness of the protective film. This reduces the occurrence of a defective, and thus a thermal head having high heating efficiency and stable quality can be manufactured.

The present invention provides a method of manufacturing a thermal head, including: forming a groove portion, which is opened in one surface of at least one of a first substrate and a second substrate to be disposed on the first substrate in a stacked state, the first substrate and the second substrate each being of a plate shape; measuring a depth dimension of the groove portion formed in the forming of the groove portion; bonding the first substrate and the second substrate to each other in the stacked state so as to close an opening of the groove portion formed in the forming of the groove portion; forming a heating resistor on a surface of the second substrate, which is bonded onto the first substrate in the bonding, in a region opposed to the groove portion; and forming a protective film for covering and protecting the heating resistor on the second substrate, at a thickness which is set based on the depth dimension of the groove portion and a thickness dimension of the second substrate.

According to the present invention, the thickness of the protective film to be formed in the protective film forming step is set based on the depth dimension of the groove portion and the thickness dimension of the second substrate. Accordingly, fluctuations in depth among the groove portions and fluctuations in thickness of the second substrate can be cancelled through adjustment of the thickness of the protective film. This way, a plurality of thermal heads having high heating efficiency and stable quality can be manufactured.

The present invention provides a method of manufacturing a thermal head, including: forming a groove portion, which is opened in one surface of at least one of a first substrate and a second substrate to be disposed on the first substrate in a stacked state, the first substrate and the second substrate each being of a plate shape; measuring a width dimension and a depth dimension of the groove portion formed in the forming of the groove portion; bonding the first substrate and the second substrate to each other in the stacked state so as to close an opening of the groove portion formed in the forming of the groove portion; forming a heating resistor on a surface of the second substrate, which is bonded onto the first substrate in the bonding, in a region opposed to the groove portion; and forming a protective film for covering and protecting the heating resistor on the second substrate, at a thickness which is set based on the width dimension and the depth dimension of the groove portion and a thickness dimension of the second substrate.

According to the present invention, the thickness of the protective film is set based on both of the width dimension and the depth dimension of the groove portion and the thickness of the upper substrate. Accordingly, fluctuations in dimensions of the groove portion among the cavity portions and fluctuations in thickness of the upper substrate can be cancelled with good accuracy through adjustment of the thickness of the protective film. Therefore, a plurality of thermal heads having high heating efficiency and high quality can be manufactured.

According to the present invention, the method may include: thinning the second substrate, which is bonded onto the first substrate in the bonding; and measuring the thickness dimension of the second substrate, which is thinned in the thinning.

With this configuration, in the thinning step, the second substrate can be formed to a desired thickness. Therefore, in the bonding step, instead of bonding a second substrate which is too thin to handle onto the first substrate, a second substrate which is thick enough to handle can be bonded onto the first substrate. This makes the handling of the second substrate easier and safer. Further, the thickness of the protective film is set based on the thickness dimension of the thinned second substrate measured in the substrate measuring step, and hence the protective film can be formed with good accuracy.

The present invention provides the effect that a thermal head having high heating efficiency and stable quality can be manufactured.

BRIEF DESCRIPTION OF THE DRAWINGS

In the accompanying drawings:

FIG. 9A is a table showing target design values of the thermal head, and FIG. 9B is a table showing the relationship between actual measurement values and heating efficiency;

FIG. 10A is a table showing another example of the target design values of the thermal head, and FIG. 10B is a table showing the relationship between actual measurement values and the heating efficiency; and FIG. 11A is a table showing still another example of the target design values of the thermal head, and FIG. 11B is a table showing the relationship between actual measurement values and the heating efficiency.

DETAILED DESCRIPTION OF THE PREFERRED EMBODIMENTS

Now, a method of manufacturing a thermal head according to an embodiment of the present invention is described below with reference to the accompanying drawings.

Figure 1:
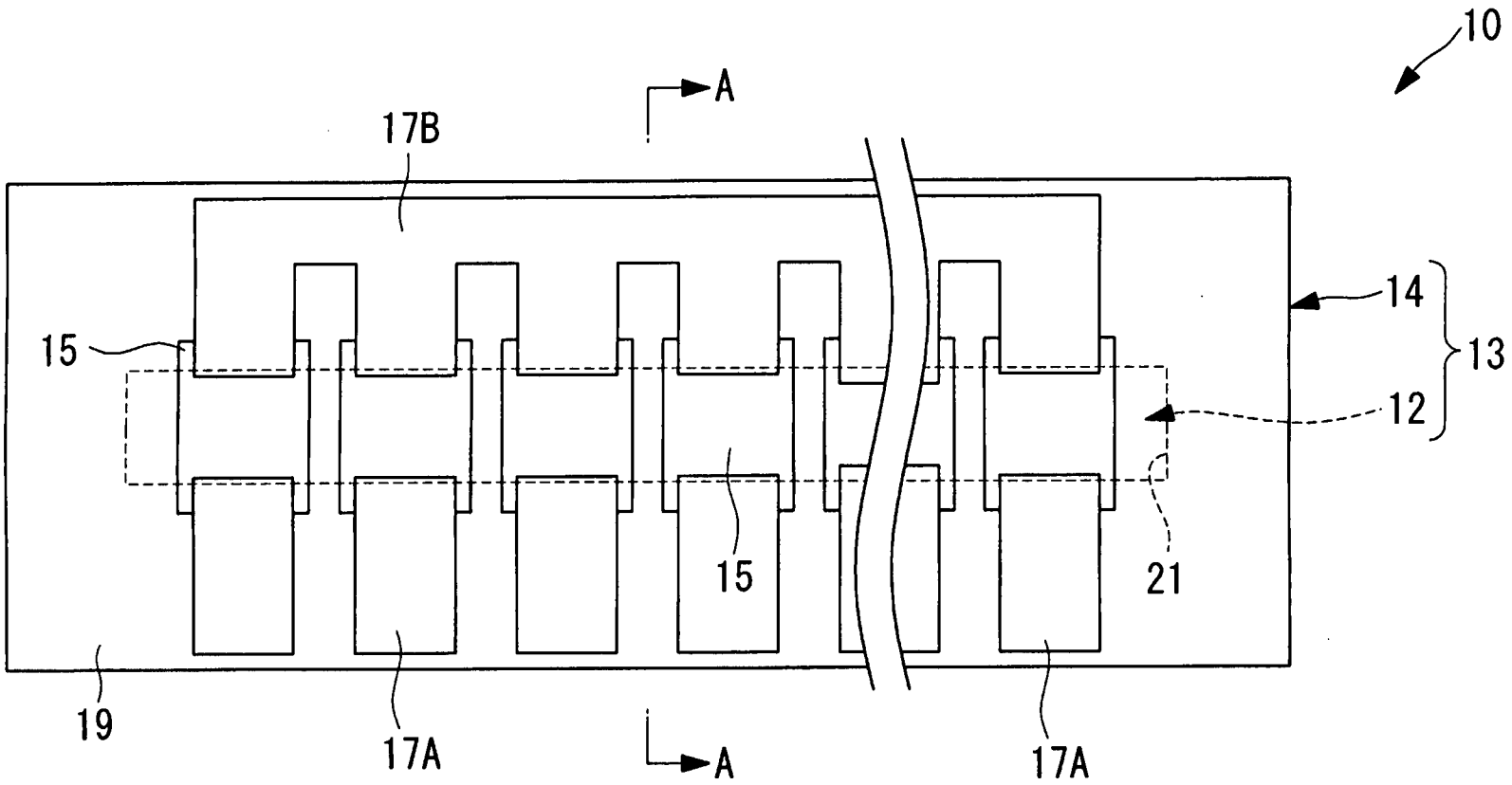
FIG. 1 is a schematic structural view of a thermal head viewed in a thickness direction according to an embodiment of the present invention.
Figure 2:
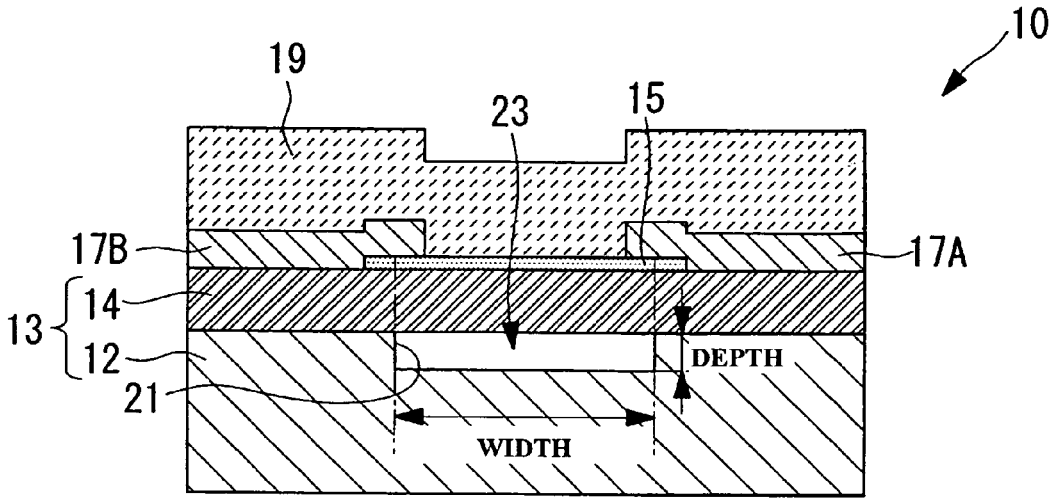
FIG. 2 is a cross-sectional view of the thermal head taken along the line A-A of FIG. 1.
Figure 3A:
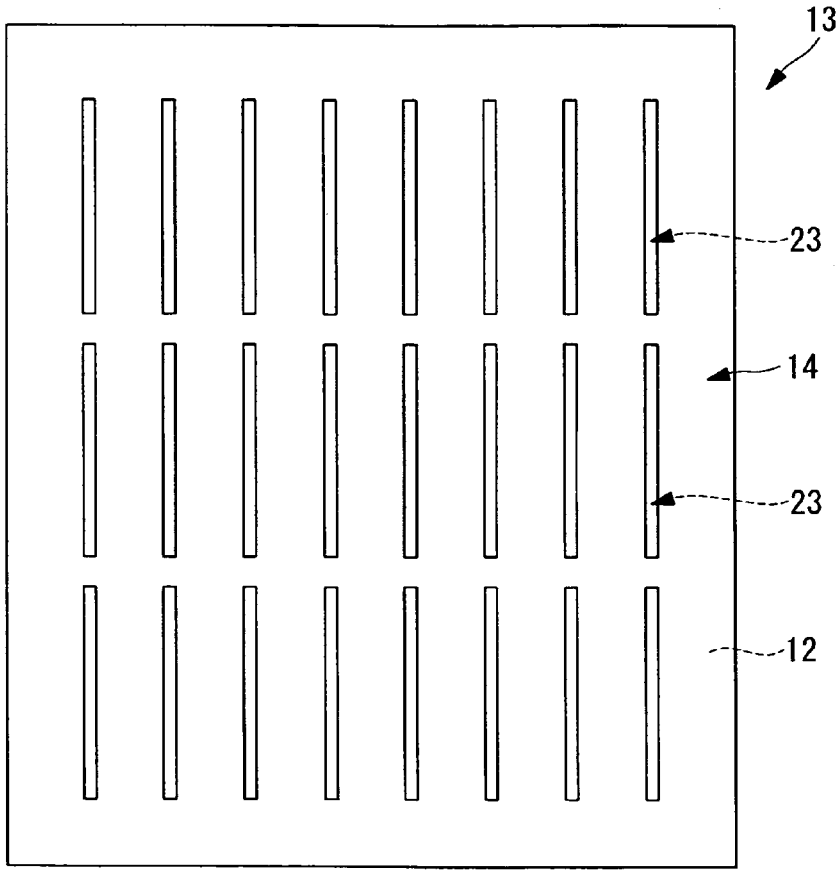
FIG. 3A is a view of a large-size stacked substrate viewed in the thickness direction which is used in a method of manufacturing a thermal head according to the embodiment of the present invention.
Figure 3B:
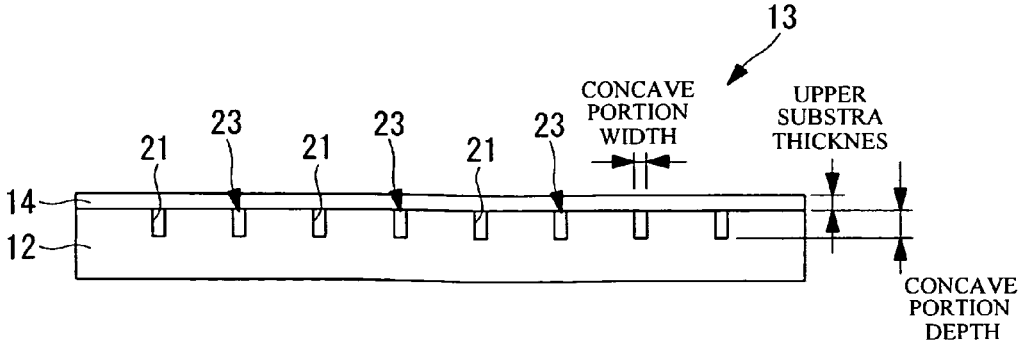
FIG. 3B is a view of the stacked substrate of FIG. 3A viewed in a longitudinal direction.

The method of manufacturing a thermal head according to this embodiment is for manufacturing, for example, as illustrated in FIGS. 1 and 2, a thermal head 10 for use in a thermal printer (not shown). In this embodiment, description is given of a method of manufacturing a plurality of thermal heads 10 from a large-size support substrate (first substrate) 12 and a large-size upper substrate (second substrate) 14 as illustrated in FIGS. 3A and 3B.

Figure 4:
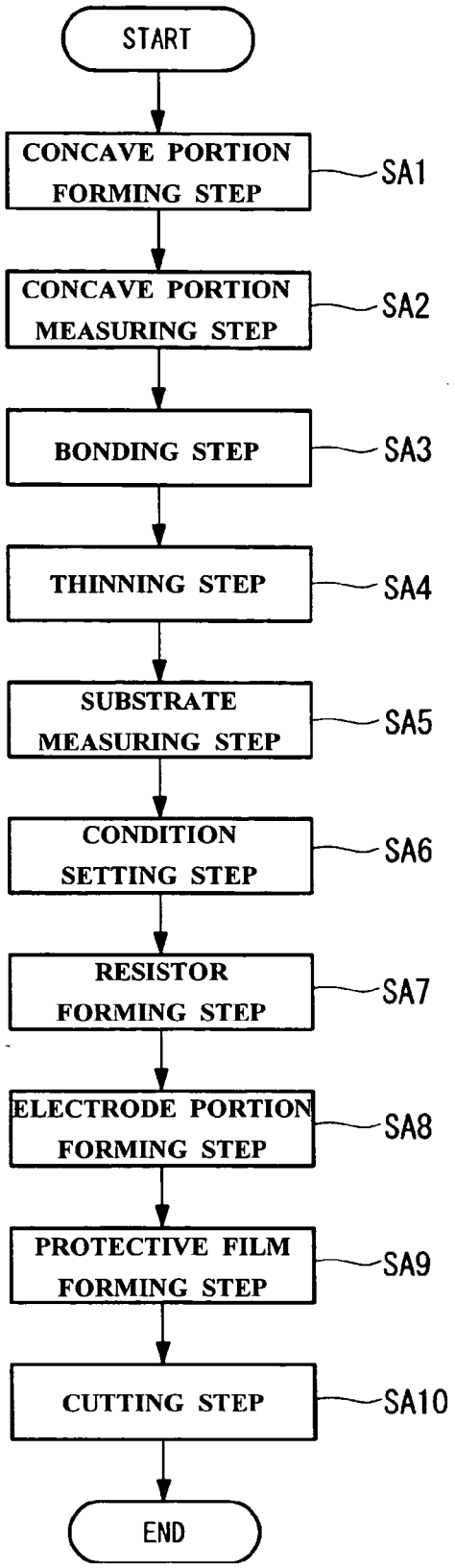
FIG. 4 is a flowchart illustrating the method of manufacturing a thermal head according to the embodiment of the present invention.

The manufacturing method of this embodiment includes, as illustrated in a flowchart of FIG. 4, a concave portion forming step (groove portion forming step) SA1 of forming a plurality of concave portions (groove portions) 21 each opened in one surface of the plate-shaped support substrate 12, a concave portion measuring step (groove measuring step) SA2 of measuring a width dimension and a depth dimension of the concave portions 21, a bonding step SA3 of bonding the upper substrate 14 onto the support substrate 12 in a stacked state, a thinning step SA4 of thinning the upper substrate 14 bonded onto the support substrate 12, a substrate measuring step SA5 of measuring the thickness of the thinned upper substrate 14, and a condition setting step SA6 of setting thickness conditions of a protective film 19 for protecting heating resistors 15 and electrode portions 17A and 17B which are formed in subsequent steps.

The manufacturing method of this embodiment further includes a resistor forming step SA7 of forming the heating resistors 15 on a surface of the upper substrate 14, an electrode portion forming step SA8 of forming the electrode portions 17A and 17B connected to the heating resistors 15 on the surface of the upper substrate 14, a protective film forming step SA9 of forming the protective film 19 based on the thickness conditions, and a cutting step SA10 of cutting the resultant substrate into the individual thermal heads 10.

Hereinafter, the respective steps are specifically described.

In the concave portion forming step SA1, as the support substrate 12, for example, an insulating glass substrate having a thickness approximately ranging from 300 μm to 1 mm is used. First, the large-size support substrate 12 is divided into regions for the individual thermal heads 10. For example, in FIG. 3A, the regions for the individual thermal heads 10 are rectangular regions obtained by dividing the large-size support substrate 12 into three in one direction and into eight in the other direction. In the concave portion forming step SA1, in one surface of the support substrate 12, rectangular concave portions 21 each extending in the longitudinal direction are formed in each region of the individual thermal heads 10 (Step SA1).

Figures 5A, 5B:
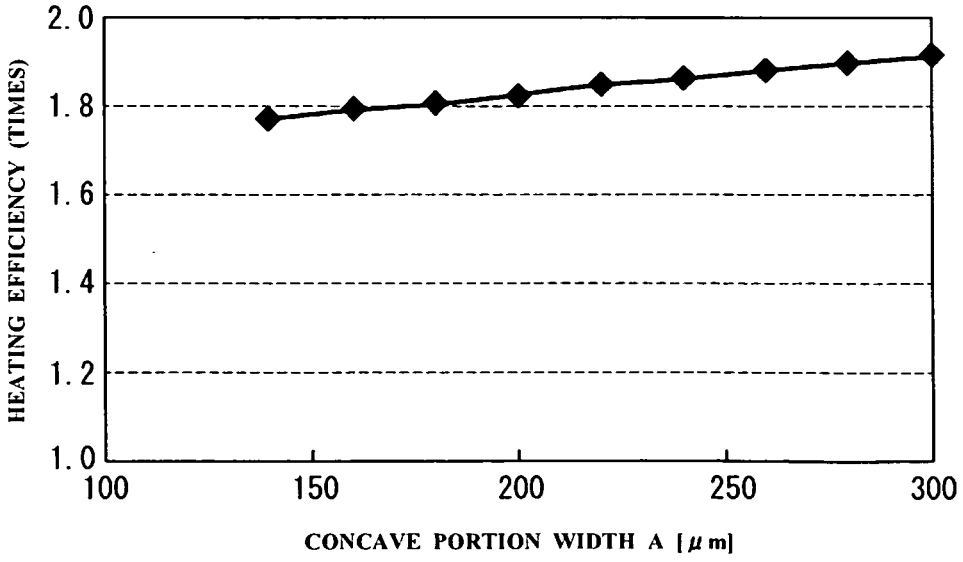
FIG. 5A is a table showing the relationship between a width dimension of a concave portion and heating efficiency.
FIG. 5B is a line graph of FIG. 5A.

A larger width dimension and a larger depth dimension of the concave portions 21 are more effective in terms of thermal efficiency, but it is necessary to suppress the dimensions within a predetermined range in order to suppress fluctuations in quality among products. For example, when a depth B of the concave portion 21 is set to 100 (μm), a thickness C of the upper substrate 14 is set to 20 (μm), and a thickness D of the protective film 19 is set to 7 (μm), as shown in FIGS. 5A and 5B, it is desired to set the width dimension of the concave portion 21 to 140 μm or larger. However, as the width of the concave portion 21 is larger, the strength of the upper substrate 14 is weakened. Accordingly, it is desired to set the width dimension of the concave portion 21 to 300 μm or smaller as a practical range. FIGS. 5A and 5B show heating efficiency in comparison to that of a conventional commonly-used thermal head. The same is applied to FIGS. 6A and 6B, FIGS. 7A and 7B, and FIGS. 8A and 8B described below.

Figures 6A, 6B:
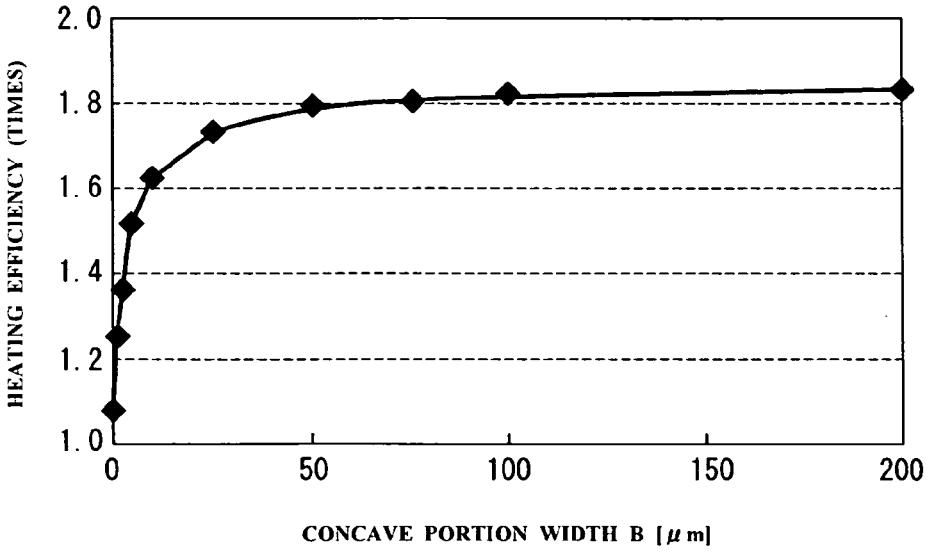
FIG. 6A is a table showing the relationship between a depth dimension of the concave portion and the heating efficiency.
FIG. 6B is a line graph of FIG. 6A.

Further, processing cost is required to increase the depth of the concave portion 21. For example, when a width A of the concave portion 21 is set to 200 (μm), the thickness C of the upper substrate 14 is set to 20 (μm), and a thickness D of the protective film 19 is set to 7 (μm), as shown in FIGS. 6A and 6B, the heating efficiency shows little difference as long as the depth of the concave portion 21 is 100 μm or larger. Therefore, it is desired to set the width dimension of the concave portion 21 to approximately 100 μm as a practical range.

The concave portion 21 can be formed by performing, for example, sandblasting, dry etching, wet etching, laser machining, or drill machining on the one surface of the support substrate 12. When sandblasting is performed, the one surface of the support substrate 12 is covered with a photoresist material. Then, the photoresist material is exposed to light using a photomask of a predetermined pattern so as to be cured in part other than the region for forming the concave portion 21.

After that, the surface of the support substrate 12 is cleaned and the uncured photoresist material is removed. Thus, an etching mask (not shown) having an etching window formed in the region for forming the concave portion 21 can be obtained. In this state, sandblasting is performed on the surface of the support substrate 12 to form the concave portion 21 having a predetermined depth.

Further, when etching, such as dry etching and wet etching, is performed, similarly to the above-mentioned processing by sandblasting, the etching mask having the etching window formed in the region for forming the concave portion 21 is formed on the one surface of the support substrate 12. In this state, etching is performed on the surface of the support substrate 12 to form the concave portion 21 having a predetermined depth.

As such an etching process, for example, wet etching using a hydrofluoric acid-based etchant or the like is available, as well as dry etching such as reactive ion etching (RIE) and plasma etching. As a reference example, in a case of a single-crystal silicon support substrate, wet etching may be performed using an etchant such as a tetramethylammonium hydroxide solution, a KOH solution, or a mixed solution of hydrofluoric acid and nitric acid.

Next, in the concave portion measuring step SA2, for example, a measuring microscope, a contact type surface roughness tester, a non-contact type laser displacement meter, or the like is used to measure the width dimensions and the depth dimensions of the concave portions 21 (Step SA2). As to a single large-size support substrate 12, it is desired to measure the width dimensions and the depth dimensions of the plurality of concave portions 21 to calculate an average width dimension and an average depth dimension.

Next, in the bonding step SA3, a glass substrate made of the same material as that of the support substrate 12 is used as the upper substrate 14. A thin glass substrate having a thickness of 100 μm or smaller is difficult to manufacture and handle, and expensive. Thus, instead of bonding an originally thin upper substrate 14 onto the support substrate 12, the upper substrate 14 which is thick enough to be easily manufactured and handled is bonded onto the support substrate 12, and then the upper substrate 14 is processed to a desired thickness in the thinning step SA4 (Step SA3).

In the bonding step SA3, first, etching masks are all removed from the surface of the support substrate 12, followed by cleaning. Then, the upper substrate 14 is laminated to the surface of the support substrate 12 so as to close all of the concave portions 21. For example, the upper substrate 14 is directly laminated to the support substrate 12 at room temperature without using an adhesive layer.

The one surface of the support substrate 12 is covered with the upper substrate 14 to close the opening of each of the concave portions 21, to thereby form a plurality of cavity portions 23 between the support substrate 12 and the upper substrate 14. In this state, the laminated support substrate 12 and upper substrate 14 are subjected to heat treatment so that the substrates are bonded to each other by thermal fusion. Hereinafter, the resultant substrate obtained by bonding the support substrate 12 and the upper substrate 14 to each other is referred to as a stacked substrate 13.

Figures 7A, 7B:
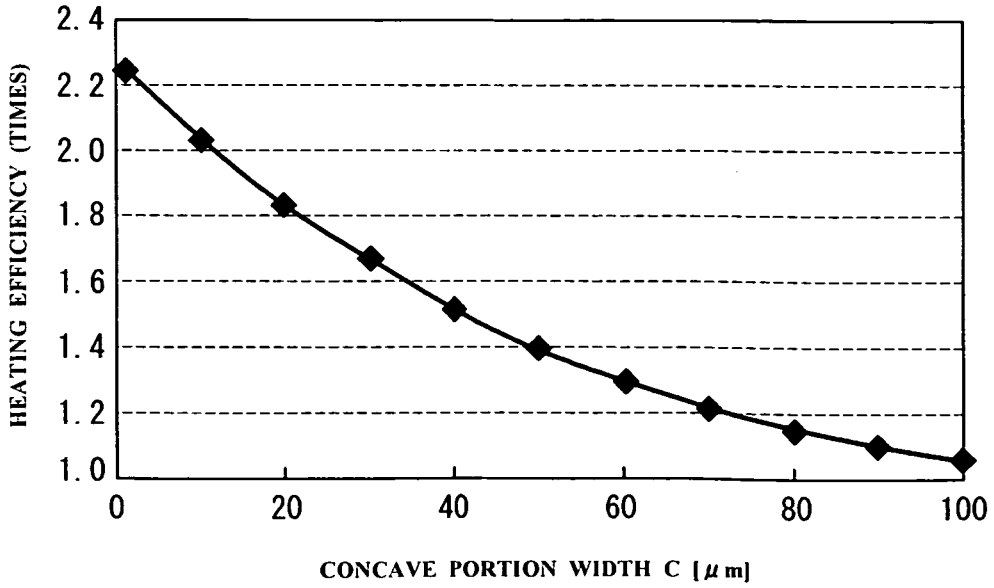
FIG. 7A is a table showing the relationship between the thickness of an upper substrate and the heating efficiency.
FIG. 7B is a line graph of FIG. 7A.

Next, in the thinning step SA4, the upper substrate 14 of the stacked substrate 13 is thinned to a desired thickness (Step SA4). The thinning of the upper substrate 14 is performed by etching, polishing, or the like. For example, when the width A of the concave portion 21 is set to 200 (μm), the depth B thereof is set to 100 (μm), and the thickness D of the protective film 19 is set to 7 (μm), as shown in FIGS. 7A and 7B, the heating efficiency is higher as the thickness of the upper substrate 14 is smaller, but the strength of the upper substrate 14 is reduced as the upper substrate 14 is thinner. It is therefore desired to set the thickness of the upper substrate 14 to at least 10 μm or larger.

For the etching of the upper substrate 14, various types of etching can be used as in the concave portion forming step SA1. Further, for the polishing of the upper substrate 14, for example, chemical mechanical polishing (CMP), which is used for high accuracy polishing for a semiconductor wafer and the like, can be used. Next, in the substrate measuring step SA5, for example, similarly to the concave portion measuring step SA2, a measuring microscope, a contact type surface roughness tester, a non-contact type laser displacement meter, or the like is used to measure the thickness of the upper substrate 14 (Step SA5). As to a single large-size upper substrate 14, it is desired to measure the thicknesses at a plurality of points to calculate an average thickness.

Next, in the condition setting step SA6, based on an average value of the width dimensions and an average value of the depth dimensions of the plurality of concave portions 21 measured in the concave portion measuring step SA2 and an average value of the thicknesses of the upper substrate 14 measured in the substrate measuring step SA5, thickness conditions of the protective film 19 are set (Step SA6).

Figures 8A, 8B:
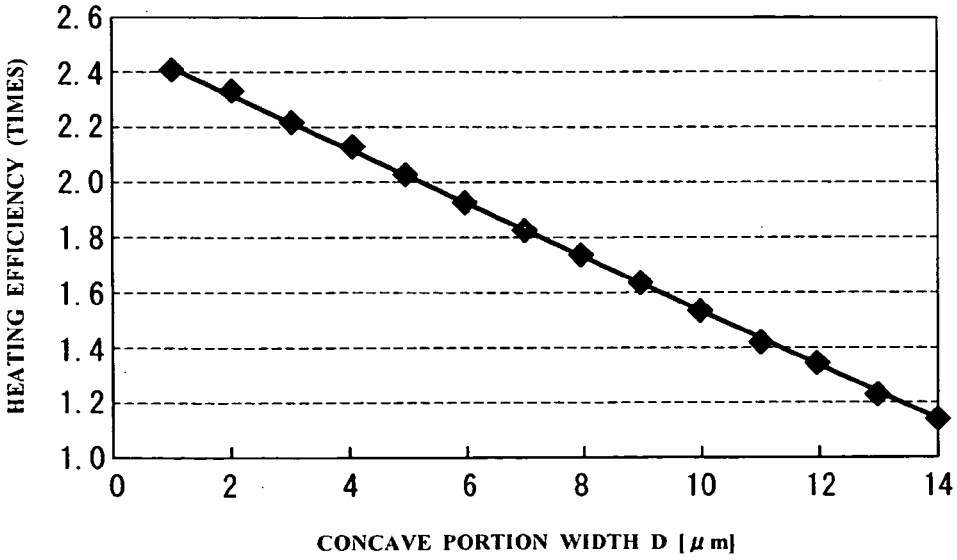
FIG. 8A is a table showing the relationship between the thickness of a protective film and the heating efficiency.
FIG. 8B is a line graph of FIG. 8A.

For example, when the width A of the concave portion 21 is set to 200 (μm), the depth B thereof is set to 100 (μm), and the thickness C of the upper substrate 14 is set to 7 (μm), as shown in FIGS. 8A and 8B, the heating efficiency is higher as the thickness of the protective film 19 is smaller, but the reliability of endurance (resistance to abrasion) of the protective film 19 is reduced when the thickness of the protective film 19 is excessively reduced. It is therefore desired to set the thickness of the protective film 19 to approximately 7 μm.

In the condition setting step SA6, the following expression is used to calculate an appropriate thickness d (μm) of the protective film 19.

$$d=D+18.302\times(0.0005\times(a-A)+0.0055\times b^{-0.69}\times(b-B)+0.01225\times e^{(-0.0084c)}\times(C-c))$$

where A is a target design value (μm) of the width of the concave portion 21, B is a target design value (μm) of the depth of the concave portion 21, C is a target design value (μm) of the thickness of the upper substrate 14, D is a target design value (μm) of the thickness of the protective film 19, "a" is an actual measurement value (μm) of the width of the concave portion 21, b is an actual measurement value (μm) of the depth of the concave portion 21, and c is an actual measurement value (μm) of the thickness of the upper substrate 14.

As shown in FIG. 9A, the target design value A of the width of the concave portion 21 is set to 200 (μm), the target design value B of the depth of the concave portion 21 is set to 100 (μm), the target design value C of the thickness of the upper substrate 14 is set to 50 (μm), the target design value D of the thickness of the protective film 19 is set to 7 (μm), and a target heating efficiency E is set to 1.39 (times). As shown in FIG. 9B, at a point (measurement value 1), when the actual measurement value "a" of the width of the concave portion 21 is 218 (μm), the actual measurement value b of the depth of the concave portion 21 is 109 (μm), and the actual measurement value c of the upper substrate 14 is 43 (μm), from the above-mentioned expression, the appropriate thickness d of the protective film 19 is 8.3 (μm).

Similarly, at another point (measurement value 2), when the actual measurement value "a" of the width of the concave portion 21 is 183 (μm), the actual measurement value b of the depth of the concave portion 21 is 92 (μm), and the actual measurement value c of the depth of the upper substrate 14 is 57 (μm), the appropriate thickness d of the protective film 19 is 5.8 (μm). Further, at another point (measurement value 3), when the actual measurement value "a" of the width of the concave portion 21 is 204 (μm), the actual measurement value b of the depth of the concave portion 21 is 102 (μm), and the actual measurement value c of the depth of the upper substrate 14 is 48 (μm), the appropriate thickness d of the protective film 19 is 7.3 (μm).

In this way, the above-mentioned expression may be used to set the appropriate thickness d of the protective film 19, that is, a target value (μm) of the protective film 19 in the protective film forming step SA9.

Further, as another example, as shown in FIG. 10A, the target design value A of the width of the concave portion 21 is set to 280 (μm), the target design value B of the depth of the concave portion 21 is set to 50 (μm), the target design value C of the thickness of the upper substrate 14 is set to 80 (μm), the target design value D of the thickness of the protective film 19 is set to 5 (μm), and the target heating efficiency E is set to 1.38 (times). In this case, as shown in FIG. 10B, at a point (measurement value 1), the appropriate thickness d of the protective film 19 is 6.1 (μm) from the above-mentioned expression. Further, at another point (measurement value 2), the appropriate thickness d of the protective film 19 is 4.1 (μm). Further, at another point (measurement value 3), the appropriate thickness d of the protective film 19 is 5.2 (μm).

Further, for example, as shown in FIG. 11A, the target design value A of the width of the concave portion 21 is set to 150 (μm), the target design value B of the depth of the concave portion 21 is set to 180 (μm), the target design value C of the thickness of the upper substrate 14 is set to 25 (μm), and the target heating efficiency E is set to 1.42 (times). In this case, as shown in FIG. 11B, at a point (measurement value 1), the appropriate thickness d of the protective film 19 is 11.1 (μm) from the above-mentioned expression. Further, at another point (measurement value 2), the appropriate thickness d of the protective film 19 is 9.1 (μm). Further, at another point (measurement value 3), the appropriate thickness d of the protective film 19 is 10.2 (μm).

Next, in the resistor forming step SA7, the plurality of heating resistors 15 are formed on the surface of the upper substrate 14 in regions opposed to the corresponding concave portion 21 (Step SA7). The heating resistors 15 are arrayed at predetermined intervals along the longitudinal direction of the corresponding cavity portion 23. The heating resistors 15 are each formed so as to straddle the cavity portion 23 in its width direction.

To form the heating resistors 15, a thin film forming method such as sputtering, chemical vapor deposition (CVD), or deposition can be used. A thin film of the material of the heating resistor such as a Ta-based or silicide-based material is formed on the upper substrate 14, and the thus obtained thin film is shaped by lift-off, etching, or the like, to thereby form the heating resistors 15 of a desired shape.

Next, in the electrode portion forming step SA8, similarly to the resistor forming step SA5, an electrode material is formed on the upper substrate 14 by sputtering, deposition, or the like. Then, the film thus obtained is shaped by lift-off or etching, or alternatively the electrode material is baked after screen-printing, to thereby form the electrode portions 17A and 17B (Step SA8). As the electrode material, for example, Al, Al—Si, Au, Ag, Cu, or Pt can be used.

The electrode portions 17A and 17B include individual electrodes 17A connected to one ends of the respective heating resistors 15 in a direction orthogonal to the array direction, and a common electrode 17B integrally connected to the other ends of all the heating resistors 15. The heating resistors 15 and the electrode portions 17A and 17B are formed in an arbitrary order. In patterning a resist material for the lift-off or etching of the heating resistors 15 and the electrode portions 17A and 17B, a photomask is used to pattern the photoresist material.

Next, in the protective film forming step SA9, a protective film material is formed on the upper substrate 14 on which the heating resistors 15 and the electrode portions 17A and 17B are formed. Then, the protective film 19 is formed at a thickness which is set in the condition setting step SA6 (Step SA9). As the protective film material, for example, $SiO_2$, $Ta_2O_5$, SiAlON, $Si_3N_4$, or diamond-like carbon is used. The film forming method to be used is sputtering, ion plating, CVD, or the like. By forming the protective film 19, the heating resistors 15 and the electrode portions 17A and 17B can be protected from abrasion and corrosion.

Next, in the cutting step SA10, the large-size stacked substrate 13 is cut for regions of the individual thermal heads 10 (Step SA10). In this embodiment, twenty-four thermal heads 10 are formed from the single large-size stacked substrate 13.

An operation of the thermal head 10 manufactured according to the foregoing embodiment is described below.

When a voltage is selectively applied to the individual electrodes 17A, a current flows through the heating resistors 15 which are connected to the selected individual electrodes 17A and the common electrode 17B opposed thereto, to thereby allow the heating resistors 15 to generate heat. The heat generated by the heating resistors 15 is transferred toward the protective film 19 side to be utilized for printing and the like, and a part of the heat is also transferred toward the support substrate 12 side via the upper substrate 14.

The upper substrate 14 having the heating resistors 15 formed on the surface thereof functions as a heat storage layer that stores the heat generated by the heating resistors 15. On the other hand, the cavity portion 23 disposed between the upper substrate 14 and the support substrate 12 so as to be opposed to the heating resistors 15 functions as a hollow heat-insulating layer that prevents the heat from transferring toward the support substrate 12 side from the heating resistors 15.

Therefore, because of the cavity portion 23, it is possible to prevent a part of the heat generated by the heating resistors 15 from transferring toward the support substrate 12 side via the upper substrate 14. Accordingly, an amount of heat transferring from the heating resistors 15 toward the protective film 19 side to be utilized for printing and the like can be increased to increase use efficiency.

In this case, the heating efficiency is determined by the dimensions of the concave portion 21, the thickness of the upper substrate 14 (distance from the heating resistor 15 to the cavity portion 23), the thickness of the protective film 19, and the like. In the method of manufacturing a thermal head according to this embodiment, the thickness of the protective film 19 to be formed in the protective film forming step SA9 is set based on the width dimension and the depth dimension of the concave portion 21 and the thickness dimension of the upper substrate 14. Accordingly, the fluctuations in dimensions among the concave portions 21 and the fluctuations in thickness of the upper substrate 14 can be cancelled through adjustment of the thickness of the protective film 19. This reduces the occurrence of a defect in the thermal heads 10, and thus a plurality of thermal heads 10 having high heating efficiency and stable quality can be manufactured.

Hereinabove, the embodiment of the present invention has been described in detail with reference to the accompanying drawings. However, specific structures of the present invention are not limited to the embodiment and encompass design modifications and the like without departing from the gist of the present invention.

For example, in this embodiment, in the protective film forming step SA9, the protective film 19 is formed in units of a large-size stacked substrate 13. Alternatively, as to a plurality of large-size stacked substrates 13, an appropriate thickness of the protective film 19 may be classified according to rank, and then a plurality of the protective films 19 may be formed in a manner that the protective films 19 are formed on the stacked substrates 13 belonging to the same class at a time.

Further, in the large-size stacked substrate 13, the protective film 19 may be formed at a thickness which is set for each thermal head 10 by measuring the dimensions of the concave portion 21 and the thickness of the upper substrate 14 for the individual thermal heads 10. In this way, thermal heads 10 with more uniform quality can be manufactured. Further, the thermal heads 10 may be individually manufactured by using support substrates 12 and upper substrates 14 which are cut into pieces in advance for the individual thermal heads 10.

Further, in the above-mentioned embodiment, the manufacturing method includes the thinning step SA4 and the substrate measuring step SA5, but as an alternative thereto, for example, an upper substrate 14 originally having a desired thickness may be laminated onto the support substrate 12. In this case, by measuring the thickness of the upper substrate 14 in advance, the thinning step 4 and the substrate measuring step SA5 can be omitted to shorten a manufacturing time period.

Further, in the above-mentioned embodiment, in the condition setting step SA6, the thickness of the protective film 19 is set based on both of the width and the depth of the concave portion 21, and the thickness of the upper substrate 14. Alternatively, however, the thickness of the protective film 19 may be set based on one of the width and the depth of the concave portion 21, and the thickness of the upper substrate 14.

Further, in the above-mentioned embodiment, in the concave portion forming step SA1, the concave portion 21 is formed in the support substrate 12. However, it is only necessary to form the concave portion 21 in at least one of the support substrate 12 and the upper substrate 14. For example, the concave portion may be formed in one surface of the upper substrate 14, or the concave portions may be formed in both of the support substrate 12 and the upper substrate 14.

Further, in the above-mentioned embodiment, in the bonding step SA3, the support substrate 12 and the upper substrate 14 are bonded to each other by thermal fusion. Alternatively, however, for example, the support substrate 12 and the upper substrate 14 may be bonded to each other by an extremely thin adhesive layer or by anodic bonding. Bonding by a thick adhesive layer is not desirable in terms of thermal efficiency.

Further, in the above-mentioned embodiment, the bonding step SA3 is performed after the concave portion measuring step SA2. However, in the case where a non-contact laser displacement meter is used, it is also possible to measure the width and the depth of the concave portion 21 after the bonding step. Therefore, in this case, the measuring step may be performed after the bonding step and immediately before the condition setting step.

What is claimed is:

1. A method of manufacturing a thermal head, comprising:

forming a groove portion in one surface of at least one of a first substrate and a second substrate to be disposed on the first substrate in a stacked state, each of the first substrate and the second substrate having a plate shape;

measuring a width dimension of the groove portion formed in the at least one of the first substrate and the second substrate;

bonding the first substrate and the second substrate to each other in the stacked state so as to close an opening of the groove portion formed in the at least one of the first substrate and the second substrate;

forming a heating resistor on a surface of the second substrate in a region opposed to the groove portion after the first and second substrates are bonded to each other; and forming a protective film for covering and protecting the heating resistor formed on the surface of the second substrate, a thickness dimension of the protective film being set so as to increase with an increase in the measured width dimension of the groove portion and so as to decrease with an increase in a thickness dimension of the second substrate.

2. The method of manufacturing a thermal head according to claim 1, further comprising:

thinning the second substrate after the first and second substrates are bonded to each other; and measuring the thickness dimension of the thinned second substrate.

3. The method of manufacturing a thermal head according to claim 1, wherein the groove portion is formed in one surface of the first substrate.

4. The method of manufacturing a thermal head according to claim 1, wherein the set thickness dimension of the protective film is calculated in accordance with the following expression:

$$d=D+18.302\times(0.0005\times(a-A)+0.0055\times b^{-0.69}\times(b-B)+0.01225\times e^{(-0.0084c)}\times(C-c)),$$

where A is a target design value (μm) of the width dimension of the groove portion, B is a target design value (μm) of the depth dimension of the groove portion, C is a target design value (μm) of the thickness dimension of the second substrate, D is a target design value (μm) of the thickness dimension of the protective film 19, a is a value (μm) of the measured width dimension of the groove portion, b is an actual measurement value (μm) of a depth of the groove portion, c is an actual measurement value (μm) of the thickness of the second substrate, and d is the set thickness dimension of the protective film.

5. The method of manufacturing a thermal head according to claim 4, further comprising:

thinning the second substrate after the first and second substrates are bonded to each other; and measuring the thickness dimension of the thinned second substrate.

6. A method of manufacturing a thermal head, comprising:

forming a groove portion in one surface of at least one of a first substrate and a second substrate to be disposed on the first substrate in a stacked state, each of the first substrate and the second substrate having a plate shape;

measuring a depth dimension of the groove portion formed in the at least one of the first substrate and the second substrate;

bonding the first substrate and the second substrate to each other in the stacked state so as to close an opening of the groove portion formed in the at least one of the first substrate and the second substrate;

forming a heating resistor on a surface of the second substrate in a region opposed to the groove portion after the first and second substrates are bonded to each other; and forming a protective film for covering and protecting the heating resistor formed on the surface of the second substrate, at a thickness dimension of the protective film being set so as to increase with an increase in the measured depth dimension of the groove portion and so as to decrease with an increase in a thickness dimension of the second substrate.

7. The method of manufacturing a thermal head according to claim 6, further comprising:

thinning the second substrate after the first and second substrates are bonded to each other; and measuring the thickness dimension of the thinned second substrate.

8. The method of manufacturing a thermal head according to claim 3, wherein the groove portion is formed in one surface of the first substrate.

9. The method of manufacturing a thermal head according to claim 3, wherein the set thickness dimension of the protective film is calculated in accordance with the following expression:

$$d=D+18.302\times(0.0005\times(a-A)+0.0055\times b^{-0.69}\times(b-B)+0.01225\times e^{(-0.0084c)}\times(C-c)),$$

where A is a target design value (μm) of the width dimension of the groove portion, B is a target design value (μm) of the depth dimension of the groove portion, C is a target design value (μm) of the thickness dimension of the second substrate, D is a target design value (μm) of the thickness dimension of the protective film 19, a is an actual measurement value (μm) of a width of the groove portion, b is a value (μm) of the measured depth dimension of the groove portion, c is an actual measurement value (μm) of the thickness of the second substrate, and d is the set thickness dimension of the protective film.

10. The method of manufacturing a thermal head according to claim 9, further comprising:

thinning the second substrate after the first and second substrates are bonded to each other; and measuring the thickness dimension of the thinned second substrate.

11. A method of manufacturing a thermal head, comprising:

forming a groove portion in one surface of at least one of a first substrate and a second substrate to be disposed on the first substrate in a stacked state, each of the first substrate and the second substrate having a plate shape;

measuring both a width dimension and a depth dimension of the groove portion formed in the at least one of the first substrate and the second substrate;

bonding the first substrate and the second substrate to each other in the stacked state so as to close an opening of the groove portion formed in the at least one of the first substrate and the second substrate;

forming a heating resistor on a surface of the second substrate in a region opposed to the groove portion after the first and second substrates are bonded to each other; and forming a protective film for covering and protecting the heating resistor formed on the surface of the second substrate, a thickness dimension of the protective film being set so as to increase with an increase in both the measured width dimension and the measured depth dimension of the groove portion and so as to decrease with an increase in a thickness dimension of the second substrate.

12. The method of manufacturing a thermal head according to claim 11, further comprising:

thinning the second substrate after the first and second substrates are bonded to each other; and measuring the thickness dimension of the thinned second substrate.

13. The method of manufacturing a thermal head according to claim 11, wherein the groove portion is formed in one surface of the first substrate.

14. The method of manufacturing a thermal head according to claim 11, wherein the set thickness dimension of the protective film is calculated in accordance with the following expression:

$$d=D+18.302\times(0.0005\times(a-A)+0.0055\times b^{-0.69}\times(b-B)+0.01225\times e^{(-0.0084c)}\times(C-c)),$$

where A is a target design value (μm) of the width dimension of the groove portion, B is a target design value (μm) of the depth dimension of the groove portion, C is a target design value (μm) of the thickness dimension of the second substrate, D is a target design value (μm) of the thickness dimension of the protective film 19, a is a value (μm) of the measured width dimension of the groove portion, b is a value (μm) of the measured depth dimension of the groove portion, c is an actual measurement value (μm) of the thickness of the second substrate, and d is the set thickness dimension of the protective film.

15. The method of manufacturing a thermal head according to claim 14, further comprising:

thinning the second substrate after the first and second substrates are bonded to each other; and measuring the thickness dimension of the thinned second substrate.

* * * * *